United States Patent [19]

Ilkcagla

[11] 4,297,806

[45] Nov. 3, 1981

[54] DANCING DOLL

[76] Inventor: Edward A. Ilkcagla, 12212 Calendula Ave., Fountain Valley, Calif. 92708

[21] Appl. No.: 96,654

[22] Filed: Nov. 23, 1979

[51] Int. Cl.[3] ..... A63H 33/00

[52] U.S. Cl. ..... 46/1 C; 46/139

[58] Field of Search ..... 46/136, 137, 267, 268, 46/1 C, 138, 139, 234, 235; 273/86 E

[56] References Cited

U.S. PATENT DOCUMENTS

| | | | |
|---|---|---|---|
| 862,625 | 8/1907 | Field | 46/137 X |
| 1,713,430 | 5/1929 | Furman | 46/136 X |
| 1,763,788 | 6/1930 | Jobe, Sr. | 46/137 X |
| 2,242,442 | 5/1941 | Smith | 46/136 X |
| 2,629,966 | 3/1953 | Russ | 46/268 X |
| 2,811,809 | 11/1957 | Franco | 46/137 X |

FOREIGN PATENT DOCUMENTS

| | | | |
|---|---|---|---|
| 1365333 | 12/1964 | France | 46/1 C |

*Primary Examiner*—Robert Peshock
*Assistant Examiner*—Mickey Yu
*Attorney, Agent, or Firm*—Paul T. Loef

[57] ABSTRACT

A dancing doll, with an articulated body, driven by speakers so that the dancing movements are generated by the beat and mood of the music. Movements may be generated directly from the speaker diaphragm or amplified through pivoted lever arms.

10 Claims, 1 Drawing Figure

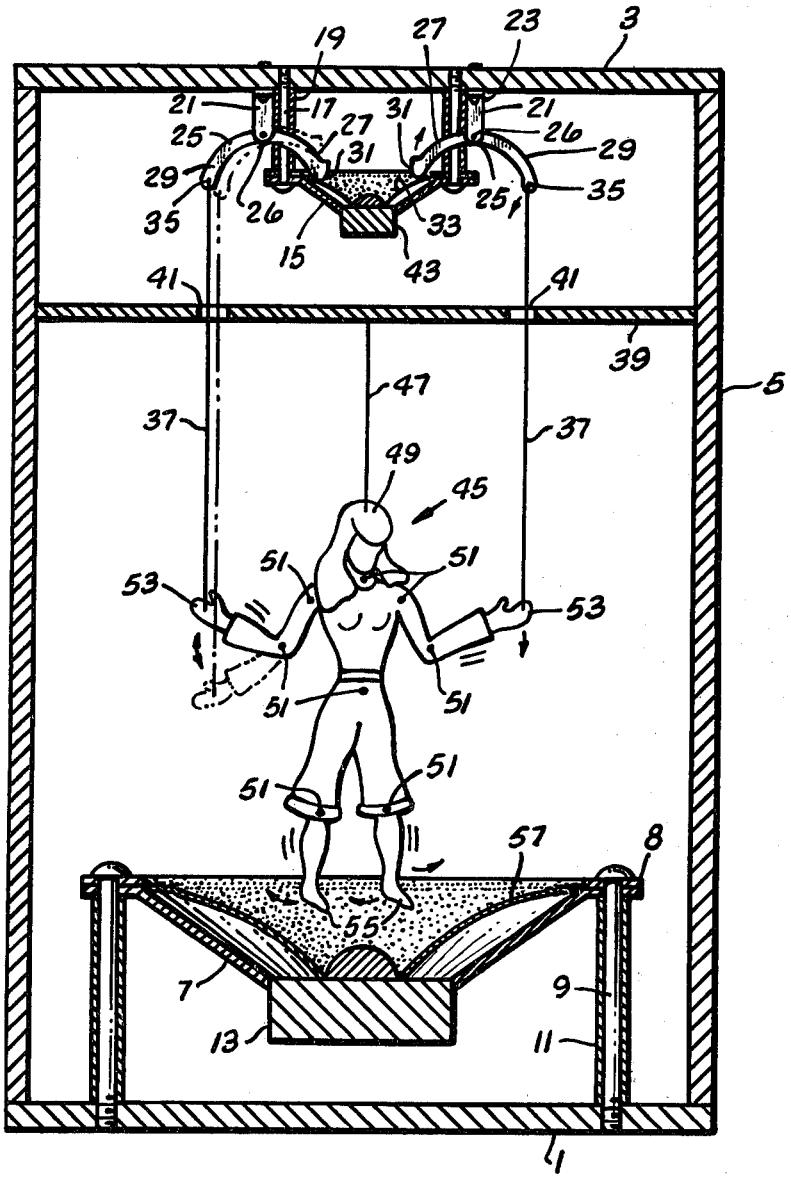
19
27
23
3
21
17
27
31
31
21
25
26
29
29
31
35
26
25
35
15
33
43
41
41
39
5
47
37
37
49
45
51
51
53
53
51
51
51
51
57
8
55
7
9
13
11
1

DANCING DOLL

BACKGROUND OF THE INVENTION

This invention relates to dancing dolls, and more particularly to dancing dolls whose random movement is generated by music.

There are two known prior art dancing dolls. One of these dolls is believed to have generated from the Appalachian Mountain area and is briefly described as an articulated doll supported in what would be the back portion of the doll by a column which is attached to a metal diaphragm which is supported on short legs. The observer hits the diaphragm supporting the column with a mallet causing the diaphragm to vibrate at its natural frequency.

The second of these known prior art dancing dolls, is believed to have generated from somewhere in the Orient, like Siam. The doll is mounted on a skirt made from a fibrous, stem material, similar to that used in a typical broom. The skirt portion of the doll rests on a metal diaphragm which also supports, on a series of columns, groups of thin small pieces of metal which are suspended from fine threads and allowed to hit each other when vibrated. The observer, as in the other art, hits the diaphragm with a mallet causing the doll to move and the metal pieces to strike each other producing a series of chimelike tones. Again, the doll motion is produced by movement of the diaphragm at its natural frequency.

It is the object of the present invention to produce a doll whose random movement is in the mood and beat of music being played and to produce a movement which simulates the movement of human dancers.

A BRIEF SUMMARY OF THE INVENTION

In summary, the dancing doll of this invention accomplishes the above objects by providing a stage whose base is a speaker transducer with a second speaker as an overhead. An articulated doll is supported by flexible string from the overhead to the head of the doll. The arms of the articulated doll are moved by pivotally supported lever arms, one end of which bears against the diaphragm of the overhead speaker. The feet of the doll are moved by the diaphragm of the speaker which forms the base of the stage. A random movement of the doll is produced by controlling the amplification of the movement as well as the dampening of the motion to produce a movement which matches the mood and beat of the music to which it is dancing. All movement is generated by the forced vibration of the speaker diaphragms which are pulsed by the electrical signals which produces the music.

BRIEF DESCRIPTION OF THE DRAWING

With reference to the drawing, wherein like reference numerals designate like portions of the invention, the FIGURE is an elevational view of the invention with the supporting structure and the speaker transducers shown in section for clarity.

DESCRIPTION OF THE INVENTION

The FIGURE is representative of a typical embodiment of the invention. Supporting structure consists of a base 1, a top 3 and sidewalls 5. The shape of the sidewalls may be cylindrical or polygonal, glass or partially enclosed or structural column members sufficient to support the upper members. Attached to the base 1 is a speaker 7 supported by screws 9 through the flange portion 8 of the speaker 7 supported by spacers 11. It is adviseable that the spacers 11 be of sufficient length to insure spacing the speaker 7 so that the driver portion 13 is free of the base 1. As shown, the screws 9 threadably engage the base 1.

Supported from the top 3 is an upper speaker 15 supported in a fashion similar to that of the lower speaker by at least three screws 17 and spacers 19. Also supported from the top 3 is a pair of fulcrums 21 secured by suitable fasteners 23. Pivotally attached to the fulcrums 21 are lever arms 25 having an inboard portion 27 and an outboard portion 29. The end 31 of the inboard portion 27 is arranged to contact the diaphragm portion 33 of the upper speaker 15. The end of the outboard portion 29 of the lever arm is equipped with a hole at 35 to which is attached a strong and flexible string 37. A decorative ceiling expanding between the sidewalls is shown at 39 with perforations at 41 to accommodate the strings 37. Attached from the ceiling 39, or alternatively from the driver portion 43 of the upper speaker 15, is another thin string 47. The string 47 supports the head portion 49 of the articulated doll 45. Typically, the doll may be articulated by joints at various locations, the more common of which are indicated at 51. However, the motions of the doll may be modified by changing the articulation points. The hands 53 of the doll 45 are attached to the string 37 and the feet 55 are arranged to just touch the diaphragm 57 of the lower speaker 7.

It should now be apparent that electrical signals generated from music either by a recording or a radio receiver fed to the speakers 7 and 15 cause the diaphragms 33 and 57 to vibrate. In the case of the upper speaker 15 the diaphragm actuates the lever arm 25 to move the arms of the articulated doll 45. Movement of the diaphragm 57 of the lower speaker 13 touches the feet 55 of the articulated doll 45 causing the doll to move. The lever arm 25 rotates about the fulcrum 21, as indicated by the reference lines to move the hands 53 of the articulated doll 45. Movement of the hands 53 can be controlled by changing the ratio of the inboard portion 27 to the outboard portion 29 of the lever arm 25. The inboard ends 31 of the lever arms 25 are typically weighted, as shown, to bias the lever arm in the direction to contact diaphragm 33. The weight can also be used to dampen the movement of the doll. Of course, friction in the articulation joints 51 also contributes to dampening of the doll movement. Movement of the doll is further controlled by location of the point on the diaphragm 33 which contacts the end 31 of the lever arm 25 as the diaphragm vibrates with multiple nodal lines providing regions of maximum movement. Not only can the movement be attenuated or amplified but the dampening can be controlled to over dampen, under dampen or critically dampen the desired movement to match the music. In other words, the articulation joints, the dampening and the movement amplification may be different for a doll to dance to disco music as compared to western music.

While the beat frequency in the music generates the doll movement it would be undersirable to move similarly with each beat as the frequency is too high. However, similar to human being dancing, it is desirable to create a random movement between select beats which generally fits the mood and beat of the music. This random movement is non-repetitive and gives the articulated doll a real live image.

From the foregoing description, it should be apparent that the articulated doll is made to move in a random fashion by the diaphragm motion of the speaker transducers to match the mood and beat of the particular music driving the speakers.

While the preferred embodiment of this invention has been described above and shown in the accompanying drawing, it is to be understood that such embodiments are merely illustrative of, and not restrictive on, the broad invention and it is not intended that the invention be limited to the specific arrangements, construction or structures described or shown, for various modifications thereof may occur to persons having ordinary skill in the art.

I claim:

1. A dancing doll, comprising:

a stage having an overhead;

a speaker having a diaphragm, supported from said overhead;

at least one fulcrum attached to said overhead;

at least one lever arm pivotally attached to said fulcrum so that the inboard end of said at least one lever arm touches said diaphragm portion of said speaker;

an articulated doll; and flexible means attached to the outboard end of said at least one lever arm and connected to a portion of said articulated doll.

2. The dancing doll as described in claim 1 wherein a second speaker, having a diaphragm, is supported on said base and said articulated doll is supported by said flexible means from said outboard ends of said at least one lever arm so that the feet portion of said doll just touch said diaphragm portion of said second speaker.

3. The dancing doll as described in claim 1 wherein the inboard end of said at least one lever arm is weighted so as to bias the lever arms against said diaphragm portion of said second speaker.

4. The dancing doll as described in claim 3 wherein said at least one lever arm is proportioned so that the outboard portion is adjusted in relationship to the inboard portion measured from said fulcrum so that the movement of said outboard end is amplified or attenuated.

5. The dancing doll as described in claim 3 wherein two said lever arms are pivotally connected to two said fulcrums and said flexible means attached to said outboard ends of said lever arms are connected to the arm portions of said articulated doll.

6. The dancing doll as described in claim 5 further comprising a second set of two said lever arms pivotally connected to two of said fulcrums and said flexible means attached to said outboard ends of said second set of said lever arms connected to the hip joints of said articulated doll.

7. The dancing doll as described in claim 3 wherein said flexible means supporting said doll and said flexible means between said outboard end of said lever arm and said portions of said doll is string.

8. The dancing doll as described in claim 7 further comprising a ceiling below said speaker with perforations therein for said strings to penetrate.

9. The dancing doll as described in claim 3 wherein said pivot connecting said at least one lever arm to said fulcrum is a friction joint so as to dampen the movement of said lever arm.

10. The dancing doll as described in claim 3 wherein said speaker is particularly responsive to the beat frequencies.

* * * * *